United States Patent [19]

Hardy

[11] 4,360,003

[45] Nov. 23, 1982

[54] WOOD BURNING HOT WATER HEATER

[76] Inventor: Willie J. Hardy, Rte. 4, Box 156, Philadelphia, Miss. 39350

[21] Appl. No.: 190,832

[22] Filed: Sep. 25, 1980

[51] Int. Cl.[3] ..... F24B 9/00; F24D 3/00

[52] U.S. Cl. ..... 126/368; 122/33; 237/8 A; 237/59; 236/9 A

[58] Field of Search ..... 126/347, 363, 361, 364, 126/367, 368, 374, 5, 54, 20, 21 A, 286, 351; 122/33; 237/8 A, 59; 236/9 A, 38

[56] References Cited

U.S. PATENT DOCUMENTS

| | | | |
|---|---|---|---|
| 1,493,453 | 5/1924 | Niffenegger | 126/368 |
| 1,522,943 | 1/1925 | Calhoun | 126/368 |
| 1,633,759 | 6/1927 | Breese, Jr. | 126/364 X |
| 1,642,600 | 9/1927 | Burkman | 126/114 X |
| 1,710,665 | 4/1929 | Mertzanoff | 122/15 |
| 2,159,284 | 5/1939 | Miller | 236/9 A X |
| 2,246,138 | 6/1941 | Lum | 236/9 A |
| 2,312,353 | 3/1943 | Miller | 236/9 A |
| 4,127,107 | 11/1978 | Melgeorge | 126/361 |
| 4,226,195 | 10/1980 | Lindroos | 122/33 X |
| 4,240,362 | 12/1980 | Wigdahl | 122/33 X |

FOREIGN PATENT DOCUMENTS

| | | | |
|---|---|---|---|
| 1263381 | 1/1959 | France | 126/5 |
| 506731 | 3/1976 | U.S.S.R. | 126/5 |

*Primary Examiner*—Samuel Scott
*Assistant Examiner*—Randall L. Green
*Attorney, Agent, or Firm*—Harvey B. Jacobson

[57] ABSTRACT

A heating device for supplying hot water to home heating systems and hot water faucet outlets in the home includes a combustion chamber which is adapted to burn wood fuel for supplying the necessary heat. The heating device comprises a base member containing an ash bin and ash door for the removal of burnt fuel, a water tank positioned on the base and sealed thereto, the water tank containing therein the combustion chamber which includes a grate which rests over the ash bin, the water in the water tank substantially completely surrounding the combustion chamber, the combustion chamber further including an exhaust pipe for removing exhaust combustion gases from the combustion chamber out of the heating device, the water tank being fully enclosed by an insulating shell which fits over the top thereof. A thermostat is used to sense the temperature of the water and actuate a solenoid for opening and closing an air intake duct in the ash bin controlling the amount of air passing through the ash bin and into the combustion chamber whereby the rate of combustion in the combustion chamber can be accurately controlled. An auxiliary hot water coil is placed in the water tank for heating water passing through the coils for use in the home hot water faucet outlets.

3 Claims, 6 Drawing Figures

WOOD BURNING HOT WATER HEATER

BACKGROUND OF THE INVENTION

1. The invention relates to hot water heating systems, and in particular to a device for heating water by the combustion of a low grade fuel such as wood and which can supply substantially all of the hot water requirements of a conventional household.

2. Disclosure Statement

Typically, a home heating system utilizing hot water includes a heat source, a water circulation system for passing cool water near the heat source, conducting the heated water to remote radiators, and returning the water to the heat source for reheating, a water temperature sensing device for controlling the rate of combustion in the heat source, and a thermostat for controlling the rate of circulation throughout the system. Typical forced air heating systems pass cool air near a heat source and into the heat duct work system throughout the house. Commonly, the heat source is a furnace which burns a high grade fuel such as natural gas, oil, or high grade coal. Such fuels are characterized by their steady, easily adjustable rate of combustion. However, such fuels are also characterized by their relatively high cost, which is steadily increasing, especially with respect to home heating oil and even natural gas.

It has therefore become desirable to find alternative fuels which are less expensive than conventionally used fossil fuels to heat homes, not only to save cost to the homeowner, but also to conserve our supplies of needed fossil fuels.

Recently, there has been a great interest in finding alternative fuels as a heat source for providing hot water for heating homes. Many solar heating systems, for example, have been patented. Likewise, there has been a renewed interest in utilizing wood fuel as an alternative energy source. For instance, U.S. Pat. No. 4,127,107 to Melgeorge discloses an auxiliary heating device for standard hot water type home heating systems in which the auxiliary heating device comprises a water chamber surrounding a fire chamber which is used for burning wood fuel. Temperature sensing devices are included to control the combustion rate of the fuel. Melgeorge, however, does not provide an ash bin for collecting the spent fuel nor does the assembly of the auxiliary heating device lend itself to a simple and efficient mode of production. Other patented water heating devices include U.S. Pat. No. 3,292,609 to Powell which discloses a portable heating device such as for use by campers; U.S. Pat. No. 1,119,195 to Schuck which discloses a heating device used in heating stock watering tanks during cold periods of the year; and U.S. Pat. No. 50,586, issued Oct. 24, 1865 to Horton which discloses a water boiling apparatus. None of the above patents teaches a water heater assembly similar to the present invention, nor are any of the patents disclosed as capable of providing substantially all of the hot water needs of a conventional home.

SUMMARY OF THE INVENTION

Accordingly, it is an object of the present invention to provide a heating device which burns a low grade, relatively inexpensive fuel such as wood, and which can be used to supply hot water requirements of a household.

It is another object of the invention to provide a heating device which utilizes wood fuel to heat water and which incorporates means for controlling the rate of combustion with a minimum of manual tending required.

It is still another object of the invention to provide a heating device for providing hot water which is of relatively simple and inexpensive construction, can be assembled easily and connected with the hot water heating or forced air heating system of the dwelling with a minimum amount of time, labor and structural changes.

A further object of the invention is to provide a heating device which is characterized by highly efficient heat transfer between the combustion chamber and the water tank.

Still yet another object of the invention is to provide a heating device for heating hot water which includes a temperature sensing device which will permit hot water flow into the heating system of the house only when the water is heated to a minimum temperature.

A still further object of the invention is to provide a heating device which will supply hot water to a household for domestic heating purposes and for the hot water outlets included in the faucets throughout the home.

The above objects are accomplished in the present invention by providing a generally vertically disposed, rectangularly-shaped, heating device comprising a base which rests on the ground outside the home, the base including an ash bin for collecting burnt fuel, a water storage tank, an inner combustion chamber being substantially surrounded by the water tank and including a door which can be opened at the front of the device for stoking the fire, the combustion chamber including an exhaust flue passing through the water tank for exhaust of any formed gases during combustion. An insulated outer shell is slipped over the water tank to reduce heat loss. The water tank is provided with a water outlet means for connecting the water tank with a hot water circulating means of a hot water heating system or a heat exchange means for a forced air heating system.

The grate of the combustion chamber fits across the top of the ash bin. The ash bin is provided with a draft for regulating the amount of air which passes into the combustion zone. The draft is adjusted by a solenoid motor which in turn is controlled by a thermostat which regulates the water temperature in the water tank. Thus, for example, the amount of air passing into the ash bin and into the combustion zone is controlled by a draft door which may be adjusted to be in a normally closed position, allowing only enough air into the combustion chamber to maintain some combustion of the fuel. If the temperature of the water in the water tank falls below a predetermined level, the thermostat will activate the solenoid motor, which in turn, adjusts the draft door to an open position, allowing a maximum amount of air to enter the combustion chamber and thus increasing the fuel combustion rate and water temperature. In like manner, the thermostat will deactivate the solenoid motor allowing the draft door to return to its normally closed position when the predetermined water temperature has been reached. The automatically adjustable draft door provides for a steady yet controllable combustion rate of the fuel, which is not found in an open fireplace.

In order to insure that the heat transfer between the combustion chamber and the water tank is efficient, the combustion chamber is formed in the water tank so that water will be disposed along the top, sides and back of the combustion chamber allowing a greater volume of water to be disposed adjacent the combustion zone. This allows a greater transfer of heat from the combustion chamber to the water in the water tank.

In use, the heating device of the present invention can be connected to the existing circulation system of a conventional home hot water heating systems. Likewise, the water tank can communicate with heat exchanger placed in a forced air heating circulation system whereby air passing across the heat exchanger will be heated for hot air distribution into the home. Once the water tank has been filled with cool water, logs are placed in the combustion chamber and the combustion chamber door closed after a fire is started. The thermostat is set at a predetermined setting allowing for adjustment of the air into the combustion chamber and subsequent control of the combustion of the fuel. Further controls can be provided to sense the water temperature and allow circulation of water from the water tank into the home only when the water is at a sufficient temperature to provide heat into the home. The addition of coils into the water tank for circulation of water and heat exchange with the water adjacent the combustion chamber allows hot water requirements for hot water faucet outlets, washing machines, etc., to be met. Accordingly, the heating device of the present invention is able to substantially fulfill all of the hot water requirements of a conventional household. Furthermore, the heating device of the present invention can be used as a secondary hot water source and heat source reducing the costs of producing hot water and heating a home by conventional fossil fuels.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
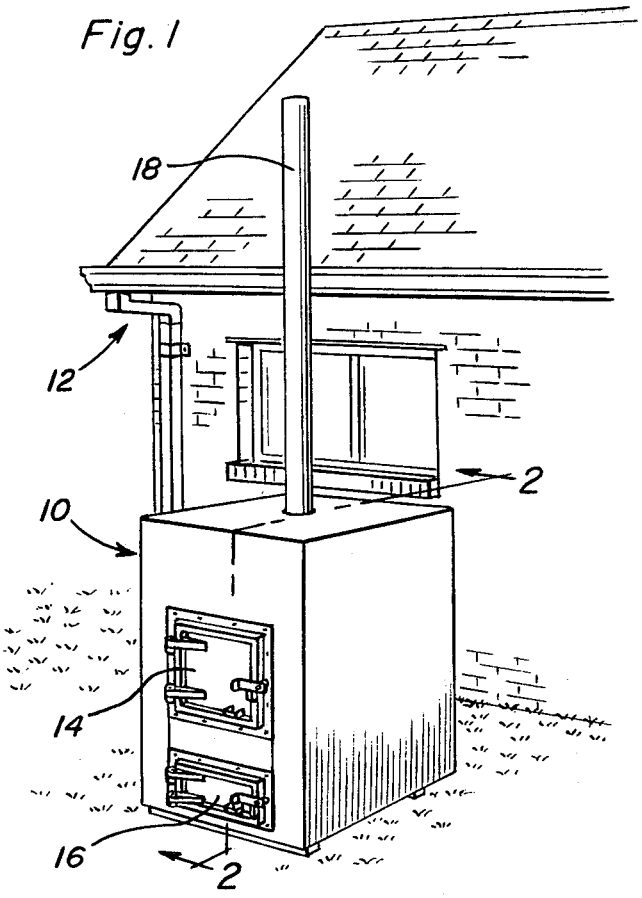
FIG. 1 is a perspective view illustrating the heating device of the present invention and its operational location outside the home.

Referring now to FIG. 1, the heating device of the present invention generally indicated by reference numeral 10 is shown placed outside home 12. Water heated in heating device 10 is pumped into the home for meeting a substantial portion, if not all of the home heating requirements and is heated for hot water household use. Heating device 10 is shown to be a generally vertically disposed rectangular heating unit comprising a door 14 for entry into the combustion chamber, a door 16 for the removal of ash, and an exhaust flue 18 which removes the gases formed during the combustion in the combustion chamber of heating device 10.

Figure 3:
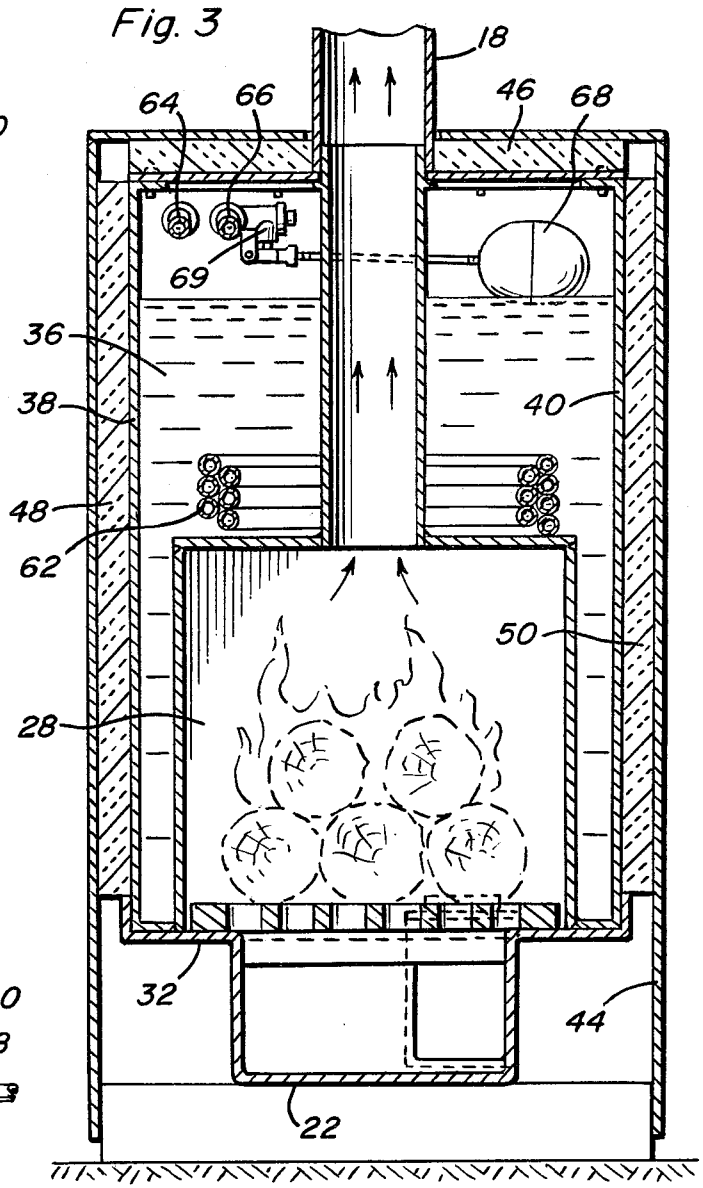
FIG. 3 is a transverse sectional view taken generally along the line 3—3 of FIG. 2.
Figure 2:
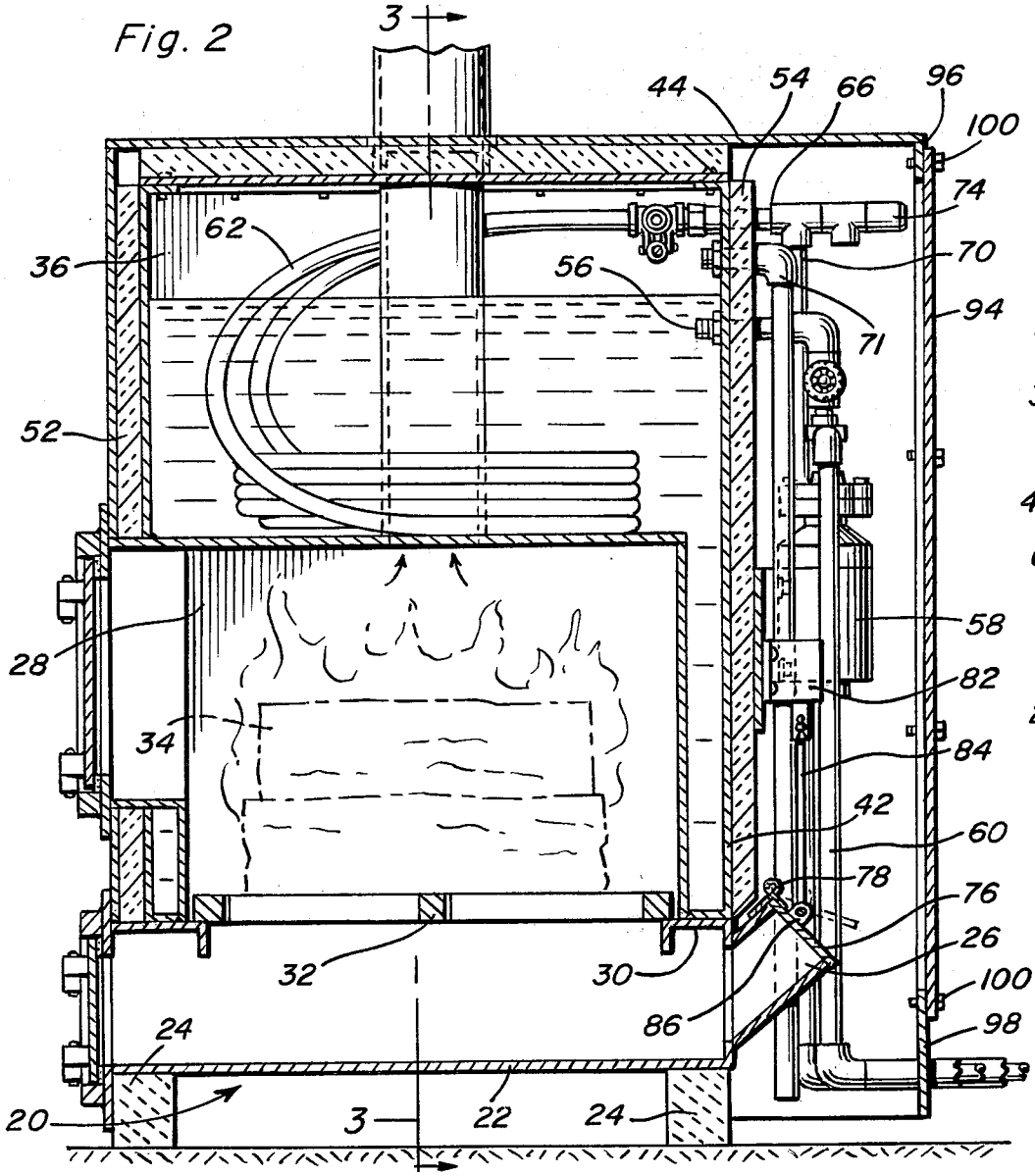
FIG. 2 is an enlarged sectional view taken generally along the line 2—2 of FIG. 1.

Heating device 10, as shown in detail in FIGS. 2 and 3 comprises a base 20 including ash bin 22 supported above the ground by supports 24 and includes a draft 26 for supplying air into combustion chamber 28 placed within water tank 36. As shown, combustion chamber 28 and water tank 36 are of a substantially rectangular-shaped chamber which set atop ash bin 22 and are supported by an inward directing full perimeter flange 30 forming a support rim on ash bin 22. Grate 32 is also supported on flange 30 atop ash bin 22 and provides support for logs 34 and allows air entering ash bin 22 through draft 26 to enter into the interior of combustion chamber 28. Combustion chamber 28 is formed as a unitary component with water tank 36 in which combustion chamber 28 is spaced from side walls 38 and 40 and rear wall 42 of water tank 36. Accordingly, water placed in the water tank will substantially surround combustion chamber 28 and accumulate adjacent the sides, top and rear of combustion chamber 28. To aid in the transfer of heat from combustion chamber 28 to the water contained in water tank 36, flue 18 extends from the interior of combustion chamber 28 through water tank 36 and exterior of heating device 10. Hot flue gases passing through exhaust flue 18 will aid in keeping the water contained in water tank 36 at the proper temperature. Placed over water tank 36 and ash bin 22 is shell 44 which is provided with a layer of insulation 46 placed along the top thereof, insulation layers 48 and 50 placed along the sides and insulation layers 52 and 54 placed along the front and the rear respectively. The respective insulation layers placed between outer shell 44 and water tank 36 greatly reduce any heat loss resulting from the difference in temperature between the interior of heating device 10 and the outside environment.

Figure 5:
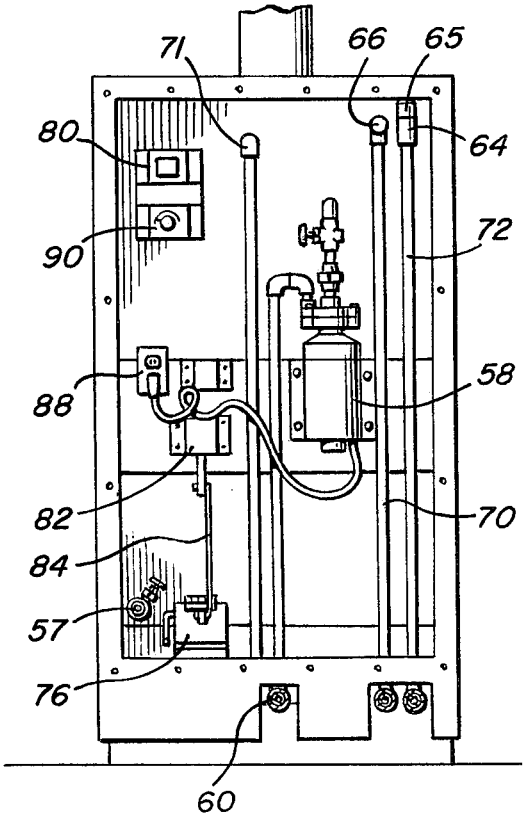
FIG. 5 is a rear elevational view of the heating device with the insulating shell taken away illustrating the placement of the controls.

Water contained in water tank 36 and heated by the combustion of fuel 34 in combustion chamber 28 is primarily used for home heating in which the hot water can be pumped to existing hot water heating systems or into heat exchange coils placed in a conventional forced air heating system for transfer of heat to the air passing through the coils. Water contained in water tank 36 and heated to the proper temperature is pumped from the water tank through outlet 56 by means of pump 58 and into water outlet line 60 for entry into the heating system of home 12. Water is returned fromn the heat exchanger in the home to inlet 57 placed at the rear of device 10. Placed in the upper end of water tank 36 is hot water coil 62 through which cool water enters from inlet 64 and is circulated through coil 62 and heated by heat transfer from the heated water in tank 36 and passed through outlet 66 into the home for meeting hot water needs for faucets, washing machines, and the like. Coil 62 is preferably conventional copper tubing which provides for efficient heat transfer. Copper tubing 62 is provided with float valve 69 which is placed upstream from outlet 66. Accordingly, if the water level in water tank 36 is low float 68 will open valve 69 causing a portion of the water circulating in coil 62 and passing to outlet 66 to fill water tank 36 until the water level rises to the desired level. Water entering outlet 66 from coil 62 passes through piping 70 and into the home for domestic consumption while cool water from the water supply is passed through coil 62 via piping 72, as shown in FIG. 5. A pressure relief valve 74 is provided on outlet 66 providing relief in the event that water temperature in coil 62 becomes extreme and the expansion of steam in the copper tubing becomes too great. Overflow 71 further regulates the water level in tank 36. Placed on inlet 64 is vacuum breaker 65 such as a vacuum relief valve of conventional construction and as commonly commercially available from sources such as from Hardy Manufacturing Company, Inc., Route 4, Box 156, Philadelphia, MI 39350 and others, the breaker to prevent accidental siphoning of tank water into the home water supply. One of the important features of heating device 10 is the regulation of the water temperature. As shown in FIG. 2, draft 26 comprises a draft door 76 which can be opened and closed about hinge 78 secured to draft 26. The opening and closing of draft door 76 is regulated by the control mechanism 82, 84 illustrated in FIGS. 2, 5 and 6. By regulating the opening and closing of draft door 76, the amount of air entering combustion chamber 28 can be controlled, providing efficient control of the amount of combustion and hence the control of the temperature of the water contained in water tank 36. Water contained in water tank 36 is sensed and maintained at the proper temperature by thermostat 80 which is linked to a solenoid motor 82. Rod 84 is attached to motor 82 and will move linearly and is linked to latch 86 welded or otherwise fastened to draft door 76. Movement of solenoid motor 82 in response to the water temperature will cause a corresponding movement of draft door 76 through linkage rod 84 regulating the amount of air passing through draft 26 and consequently into combustion chamber 28. Accordingly, if thermostat 80 senses a water temperature which is below a predetermined temperature, solenoid motor 82 will be operated, lifting linkage rod 84 and opening draft door 76 to allow an increased amount of air to enter into combustion chamber 28, thereby increasing the amount of combustion and providing more heat to the water surrounding combustion chamber 28 in water tank 36. Once the water temperature has reached the predetermined value, the solenoid motor will deactivate causing linkage rod 84 to fall closing draft door 76 and thus providing only minimum amounts of air to support combustion to maintain the water temperature at the proper level. Thermostat 80 is operated by means of an electrical current through conventional electrical outlet 88.

Figure 6:
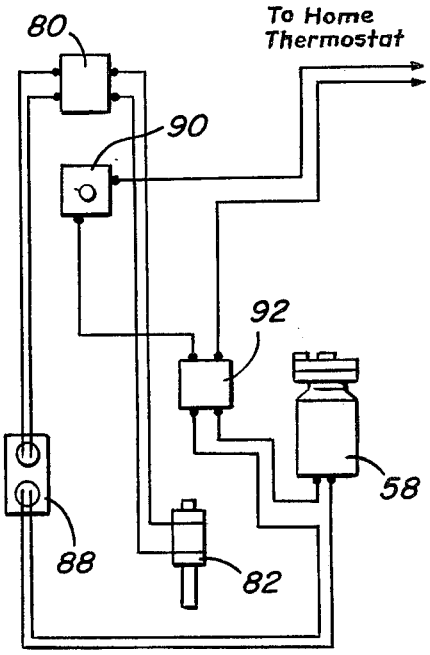
FIG. 6 is a schematic electrical diagram of the control system.
Figure 4:
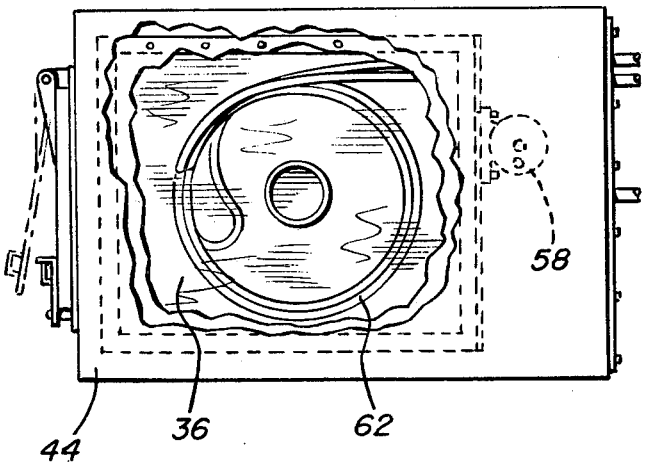
FIG. 4 is a top plan view of the heating device of the present invention in which the top of the insulating shell and top of the water tank have been broken away to illustrate the placement of hot water heating coils.

A further control system provided on heating device 10 allows hot water formed in water tank 36 to be pumped into the heating system of home 12 only when the temperature of the water is sufficient to provide efficient heating and when thermostats in the home call for heat. This control system is illustrated in FIG. 6 in which reference numeral 90 is a temperature sensing device which senses the water temperature of the water contained in water tank 36 and is coupled to a home thermostat (not shown) and relay 92 positioned at the back of heating device 10. The home thermostat is also coupled to relay 92. Pump 58 is operated through an electrical current from outlet 88 and is series coupled with relay 92. In operation, temperature sensing device 90 senses the temperature of water contained in water tank 36 and if at a predetermined temperature, and if the home thermostat requires heat, pump 58 will operate sending hot water from water tank 36 into the home via pipe 60. Likewise, if the home thermostat requires heat but the temperature of the water contained in water tank 36 is not at the proper level, pump 58 will not operate preventing insufficiently heated water from entering the heating system and causing the possibility of blowing cool air rather than hot air into the home.

In operation, heating device 10 is connected to an existing home heating system such as a hot water circulation system or a forced air heating system so that cool water entering water tank 36 and then heated can be pumped out of tank 36 through outlet 56 to remote heat radiators disposed about the home or to heat exchange coils placed in the duct work of a forced air heating system. Wood is stoked into fire chamber 28, combustion initiated and door 14 is closed. The temperature to which it is desired to heat the water in tank 36 is set on thermostat 80. If the temperature of water in water tank 36 is below the predetermined temperature setting, thermostat 80 actuates solenoid motor 82 moving linkage rod 84 and opening draft door 76 to allow more air to enter combustion chamber 28 and promote a higher rate of combustion therein. When the water temperature in water tank 36 reaches the predetermined temperature, thermostat 80 deactuates solenoid motor 82 to return draft door 76 to the closed position via linkage rod 84. The substantially closed nature of combustion chamber 28, in combination with the recited temperature control produces a controlled rate of fuel combustion which is regulated with a minimal amount of manual tending. All that is required is that fire chamber 28 be stoked with wood occasionally. The additional control of temperature sensing device 90 insures that only hot water will enter the home heating system as discussed above. Likwise, hot water for hot water outlets and faucets, washing machines, dishwashers, and the like for home domestic use and consumption, can be provided through coil 62 in which cool water from a home water supply enters through inlet 64, circulates through copper tubing 62, is heated by heat exchange from the hot water contained in water tank 36 and leaves through outlet 66 to provide these hot water requirements.

It is possible to combine heating device 10 with a conventional solar heating system in which water tank 36 will operate as the storage tank and possible secondary heating device for water which has been heated by conventional solar panels situated on the roof of home 12 or elsewhere.

Ash bin 22, water tank 36 containing combustion chamber 28 are preferably formed of stainless steel. Outer shell 44 is formed of thin sheet metal. The assembly of the device in three components which are of a primarily rectangular shape enables heating device 10 to be manufactured simply without intensive use of labor. Rear covering 94 is fastened to upper and lower flanges 96 and 98, respectively, of shell 44 by means of bolts 100 and can be removed for easy access to the piping and regulating mechanisms.

From the foregoing, it will be seen that an easily assembled and installable wood burning heating device which maintains a predetermined water temperature and automatically regulates the rate of fuel combustion and which can either supplement a primary heating system for the home or provide substantially all of the heating and hot water needs for a home has been realized in the present invention.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A heating system for providing hot water in a home heating system and hot water for a domestic water system comprising a base, a combustion chamber placed above said base and capable of burning wood fuel, said base including an ash bin in communication with said combustion chamber for receiving ashes from spent fuel and including an opening means to allow air to enter through said bin and pass into said combustion chamber, a water tank having an outlet under a predetermined water level of the tank coupled to a home heating system and an inlet coupled to said home heating system for return of water to the tank, the tank substantially enclosing said combustion chamber, an exhaust gas flue communicating with the interior of said combustion chamber and passing through said water tank and into the atmosphere, a door for said combustion chamber to allow filling of said combustion chamber with wood fuel, a bottom door at one end of said ash bin for removal of ashes therefrom, a draft door for said opening means at another end of said ash bin and being movable to control the amount of air flowing therethrough, said draft door being linked to a motor for opening said draft door whenever the temperature of the water falls below a predetermined value and closing said draft door whenever the temperature of the water in the tank exceeds a predetermined value, a temperature responsive means for sensing the temperature of water contained in said water tank and controlling said motor and draft door, a metal shell means surrounding said water tank and including a layer of insulation therein to minimize heat loss from said water tank, tubing including an inlet coupled to a water supply and an outlet coupled to said domestic water system for circulation of water through the tubing and into the domestic water system and positioned in said water tank in encircling relation to the exhaust gas flue for heating cool water passing therethrough by heat exchange with water contained in said water tank and for supplying hot water to the domestic water system, said combustion chamber being a unitary component of said water tank positioned on an inwardly directed rim formed on said ash bin, means automatically controlling the flow of heated water from said water tank through said home heating system and return to said tank in response to the demand of the home heating system and the temperature of the water in the tank, said flow controlling means including temperature sensing means for sensing the temperature of water in said water tank, said temperature sensing means being electrically connected to a home heating system thermostat, a relay electrically connected to said temperature sensing means and said home thermostat, a pump for pumping water from the water tank through the home heating system, said pump being electrically connected to said relay, whereby the pump is operable only when the temperature of water in said water tank reaches a predetermined value and said home thermostat calls for heat, vacuum breaker means coupled to said inlet for said tubing preventing siphoning of tank water into the domestic water system, float valve controlled outlet means coupled to said tubing within the water tank to fill the tank to a predetermined level and relief valve means coupled to said tubing providing relief in the event of excessive water temperature and pressure in said tubing.

2. A heating system for providing hot water comprising an ash bin and a vertically orientated rectangular-shaped water tank placed above said ash bin and having an outlet under a predetermined water level of the tank coupled to a home heating system and having an inlet coupled to said home heating system for return of water to the tank, said water tank including an enclosed combustion chamber of substantially rectangular shape placed over said ash bin and in communication therewith, said water tank capable of holding water adjacent the top, rear and sides of said combustion chamber, said heating system including a draft door for allowing air to enter said combustion chamber, a flue outlet to exhaust combustion products from said combustion chamber, said draft door being automatically adjusted in response to a temperature responsive device sensing the temperature of water contained in said water tank to control the amount of air passing through said draft door, a cover for enclosing said water tank along the top and sides thereof, tubing placed in said water tank and including an inlet and outlet for circulation of water through said tubing and into a home domestic consumption system, a linkage rod connecting said draft door to a motor, said motor being electrically controlled by said temperature responsive device for opening said draft door whenever the temperature of the water falls below a predetermined value, vacuum breaker means coupled to said inlet for said tubing to prevent siphoning of tank water into the home domestic consumption system, float valve means coupled to said outlet for said tubing to fill the tank until the water level rises to a predetermined level and shuts off and relief valve means coupled to said outlet tubing to provide relief in the event of excessive water temperature and pressure in said tubing.

3. The heating system of claims 1 or 2 wherein said tank is coupled to an overflow pipe to remove excess water in the tank when present.

* * * * *